United States Patent [19]

Sugimoto et al.

[11] Patent Number: 4,551,421

[45] Date of Patent: Nov. 5, 1985

[54] SILVER HALIDE PHOTOGRAPHIC MATERIALS

[75] Inventors: Tadao Sugimoto; Hideo Ikeda; Koki Nakamura, all of Kanagawa, Japan

[73] Assignee: Fuji Photo Film Co., Ltd., Kanagawa, Japan

[21] Appl. No.: 579,321

[22] Filed: Feb. 13, 1984

[30] Foreign Application Priority Data

Feb. 14, 1983 [JP] Japan ..... 58-22372

[51] Int. Cl.[4] ..... G03C 1/28

[52] U.S. Cl. ..... 430/509; 430/502; 430/600; 430/603

[58] Field of Search ..... 430/603, 600, 502, 509

[56] References Cited

U.S. PATENT DOCUMENTS

| | | | |
|---|---|---|---|
| 2,996,382 | 8/1961 | Luckey et al. | 430/202 |
| 3,021,215 | 2/1962 | Williams et al. | 430/603 |
| 3,178,282 | 4/1965 | Luckey et al. | 430/202 |
| 3,367,778 | 2/1968 | Berriman | 430/411 |
| 4,309,501 | 1/1982 | Huguenard et al. | 430/603 |

FOREIGN PATENT DOCUMENTS 57-89749 6/1982 Japan .

*Primary Examiner*—Won H. Louie

*Attorney, Agent, or Firm*—Sughrue, Mion, Zinn, Macpeak and Seas

[57] ABSTRACT

A silver halide photographic material is disclosed. The material is comprised of a support base having positioned thereon a silver halide emulsion layer and a surface protective layer. The emulsion layer contains a photosensitive silver halide emulsion, an internally fogged silver halide emulsion and a compound represented by the general formula (I):

$$R_1[(R_3)_l X]_m R_3' - R_2$$

wherein the substituents within the general formula (I) are defined within the specification. The photographic material is capable of providing an image having a high maximum density at a high speed and a high contrast. The material can be processed without requiring any specific additives in a short developing period using low-temperature processing. The material also possesses high-temperature quick processing aptitude.

21 Claims, No Drawings

SILVER HALIDE PHOTOGRAPHIC MATERIALS

FIELD OF THE INVENTION

This invention relates to novel silver halide photographic materials, and more particularly to silver halide photographic materials having high sensitivity and capable of providing images having a high contrast and a high maximum density.

BACKGROUND OF THE INVENTION

In the field of photographic images composed of silver, the ratio of silver per unit area making up the image to the optical density of the image is generally called the covering power. The covering power is a measure for evaluating the optical efficiency of silver making up the image. The covering power of a silver halide photographic light-sensitive layer increases as the size of the silver halide grains decreases, and decreases as the size of the silver halide grains increases. On the other hand, the sensitivity of a silver halide emulsion layer increases as the size of the silver halide grains increase, and hence a silver halide emulsion having large grain sizes is generally used for high-speed photographic light-sensitive materials. Accordingly, a high-speed photographic light-sensitive materials requires a large amount of silver per unit area to obtain a definite image density. In other words, to obtain both high sensitivity and maximum image density, the photographic material must contain a larger amount of silver salt per unit area. This is the real circumstances of conventional high-speed photographic light-sensitive materials.

Their have been attempts at improving the covering power of silver halide photographic emulsion layers while maintaining high sensitivity. For example, techniques of incorporating various polymers in high-speed coarse grain silver halide emulsions are disclosed in British Pat. Nos. 1,048,057 and 1,039,471 and U.S. Pat. Nos. 3,043,697 and 3,446,618. Although these techniques may have some effect on improving the covering power the effect is insufficient and some of these techniques reduce the strength of coatings. In particular, when photographic materials having weak coating strengths are used in an ordinary automatic processor, part of the gelatin in the layers of the photographic materials is dissolved in a developer or a fix solution. The dissolved gelatin often sticks to fourth rollers of the automatic processor and is transferred onto the photographic materials causing stains on the photographic images.

On the other hand, U.S. Pat. Nos. 2,996,382 and 3,178,282 describe that by using a silver halide photographic material having surface latent image-type silver halide coarse grains and fine silver halide grains having fogging nuclei in the inside thereof in the same emulsion layer or in adjascent layers to each other, a photographic image having a high contrast and a high coverage power is obtained at a high sensitivity.

However, in these methods, it is impossible to obtain sufficiently high sensitivity, high density, and high contrast. Also, these conventional techniques are not desirable in that they take a long period of time for development at ordinary processing temperature and also a desired effect is not obtained by an ordinary high-temperature quick processing procedure.

In order to improve these faults, Japanese Patent Application (OPI) No. 89,749/82 (the term "OPI" indicates an unexamined publication of a patent application for open to public inspection) describes a technique of incorporating a cyclic compound including nitrogen having a thio ether compound (e.g., $C_6H_{13}OCOCH_2CH_2SCH_2CH_2SCH_2CH_2OCOC_6H_{13}$) or a thioketone group in a photographic material having a photosensitive silver halide emulsion and an internally fogged silver halide emulsion. The introduction of these additives in photographic materials are shown in the foregoing technique is desirable in that the developer for the photographic materials containing these additives can also be used for other photographic materials without reducing the shelf life of the developer as compared to the case of adding the additives to a developer. However, the foregoing technique is still insufficient for improving the faults described above.

SUMMARY OF THE INVENTION

An object of this invention is, therefore, to provide a silver halide photographic material capable of giving an image having a high maximum density at a high speed and a high contrast.

Another object of this invention is to provide a silver halide photographic material which can be processed without need of any specific additives in a shortened developing period of time at low-temperature processing as well as having a high-temperature quick processing aptitude.

As the result of various investigations for attaining the foregoing objects of this invention, the inventors have discovered that these objects can be attained by the following silver halide photographic material of this invention.

That is, according to the present invention, there is provided a silver halide photographic material comprising a support having formed thereon at least one layer comprising at least one silver halide emulsion layer, said silver halide photographic material containing a photosensitive silver halide emulsion, an internally fogged silver halide emulsion, and at least one of the compounds represented by following general formula I:

$$R_1\text{-}[(R_3)_l X]_m R'_3\text{-}R_2$$

wherein $R_1$ and $R_2$ each represents a substituted or unsubstituted alkyl group having a hydroxy group, a substituted or unsubstituted aryl group having a hydroxy group, or a substituted or unsubstituted heterocyclic ring having a hydrooxy group; $R_3$ and $R'_3$ each represents a substituted or unsubstituted alkylene group, a substituted or unsubstituted arylene group, a substituted or unsubstituted heterocyclic ring, or a combination of them; X represents $$-S-,\ -O-,\ -\overset{O}{\overset{\|}{C}}-O,\ -\overset{O}{\overset{\|}{C}}-,\ -SO_2-.\ -CONR_4-,$$

$$-NR_4\overset{O}{\overset{\|}{C}}NR_4-,\ -SO_2NR_4-,\ -NR_4-,\ -CHR_4-,\ \text{or}\ -C(R_4)_2-$$

(wherein, $R_4$ represents a hydrogen atom or $(R_5-Y)_m R_5'-R_6$; $R_5$ and $R_5'$ have the same significance as $R_3$ and $R_3'$; $R_6$ represents a substituted or unsubstituted alkyl group or a substituted or unsubstituted aryl group; Y represents $$-S-,\ -O-,\ -\overset{O}{\overset{\|}{C}}-O-,\ -SO_2-,\ -\overset{O}{\overset{\|}{C}}-,\ -NR_7-,$$

$$-CONR_7-,\ -NR_7CONR_7-,\ \text{or}\ -SO_2NR_7-;$$

$R_7$ has the same significance as $R_6$; and m represents an integer of 0 to 10); l represents 0 or 1; and n represents an integer of 1 to 110; in the formula, X, Y, $R_3$, and $R_5$ each may not be the same in each recuring case and at least one of Xs in the recuring case is a sulfur atom.

In other words, it has been found that the compound having at least two hydroxy groups in the molecule as shown in general formula I is very effective in this invention.

DESCRIPTION OF THE PREFERRED EMBODIMENTS

The compounds shown by general formula I are explained below in detail.

The alkyl group having a hydroxy group shown by $R_1$ and $R_2$ of general formula I is an alkyl group having at least one hydroxy group, such as, for example, $$-CH_2CH_2-OH,\ -CH_2-\underset{\underset{OH}{|}}{CH}-CH_3,\ CH_2\underset{\underset{OH}{|}}{CH}CH_2-OH,$$

saccharides, etc. It is preferred that the carbon number of the alkyl group be 1 to 20.

The aryl group having a hydroxy group shown by $R_1$ and $R_2$ is an aryl group having at least one hydroxy group, such as, for example,

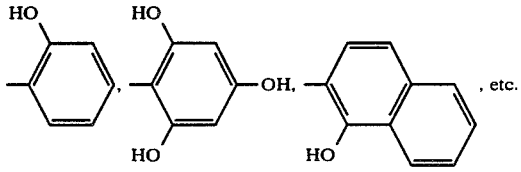

It is preferred that the carbon number of the aryl group be 6 to 20.

The heterocyclic ring having a hydroxy group shown by $R_1$ and $R_2$ is a heterocyclic ring having at least one hydroxy group. The heterocyclic ring is a saturated or unsaturated cyclic hydrocarbon (e.g., 4-membered to 6-membered) containing a sulfur atom, a nitrogen atom, or an oxygen atom.

Examples of the heterocyclic ring are

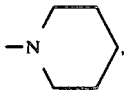

imidazole, benzimidazole, oxazole, benzoxazole, thiazole, benzthiazole, triazole, benztriazole, pyridine, pyrazine, quinoline, triazine, tetrazole, azaindene (e.g., triazaindene, tetraazaindene, petaazaindene, etc.,), purine, thiadiazole, oxadiazole, etc. Also, practical examples of the heterocyclic ring having a hydroxy group are

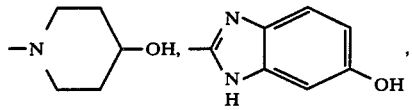

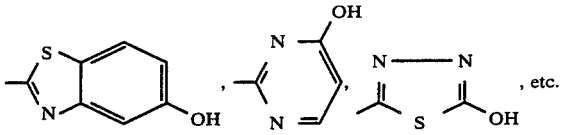

The substituents of the alkyl group, the aryl group and the heterocyclic ring are preferably a hydroxy group, a halogen atom, an amino group which may be substituted by one or two alkyl groups having 1 to 10 carbon atoms, —COOH, —COONa, —$SO_3Na$, etc. Further, the alkyl group and the heterocyclic ring represented by $R_1$ and $R_2$ may be substituted by an aryl group containing 6 to 15 carbon atoms, and the aryl group and the heterocyclic ring represented by $R_1$ and $R_2$ may be substituted by an alkyl group containing 1 to 10 carbon atoms.

Also, $R_3$ and $R_3'$ of general formula I are preferably an alkylene group having 1 to 20 carbon atoms, or an arylene group having 6 to 20 carbon atoms, and those groups each may have a substituent, which is the same substituent as the case of $R_1$ and $R_2$. (The alkylene group may be substituted by an aryl group containing 6 to 15 carbon atoms, and the arylene group may be substituted by an alkyl group containing 1 to 10 carbon atoms.)

It is preferred that X of general formula I be $$-O-,\ -S-,\ -\overset{O}{\overset{\|}{C}}-O-,\ -\overset{O}{\overset{\|}{C}}-,\ \text{or}\ -SO_2-,$$

and $R_4$ be H. It is particularly preferred that X be —S—, —O—, or —CONH—.

Furthermore, n is general formula I is 1 to 110, preferably 1 to 10, more preferably 1 to 5.

When $R_4$ is $-(R_5-Y)_m R_5'-R_6$, m is 0 to 10, preferably 0 to 5.

It is particularly preferred that Y be —S—, —O—, or —CONH—.

Examples of the alkyl group shown by $R_6$ are $$-CH_3,\ -CH_2CH_3,\ -CH_2CH_2CH_3,\ -CH-\underset{\underset{CH_3}{|}}{CH}-CH_3,\ \text{etc.},$$

and it is preferred that the carbon number ot the alkyl group be 1 to 20.

Also, examples of the aryl group shown by $R_6$ are

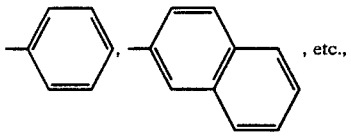

and it is preferred that the carbon atom number of the aryl group be 6 to 20. Furthermore, $R_6$ may be substituted by the same substituents as the case of $R_1$ and $R_2$.

In regard to $(R_3—X)_m$, the term that when n is 2 or more, X and $R_3$ each may not be the same at the recurring case means that when $(R_3—X)_m$ is differently expressed as $(R_3)_1—X_1—(R_3)_2—X_2—(R_3)_3—X_3—(R_3)_n—X_n—$, $(R_3)_1$ to $(R_3)_n$ and $X_1$ to $X_n$ each may be different. For example, such a case includes —S—$CH_2$—S—, —$CH_2$—S—$CH_2$—S—, —S—$CH_2CH_2$—S—, —S—$CH_2CH_2$—S—$CH_2CH_2$—S—, —S—$CH_2CH_2$—O—$CH_2CH_2$—S—, —S—$CH_2CH_2$—CONH—$CH_2$—CONH—$CH_2CH_2$—S—, —S—$CH_2CH_2CH_2$—NHCONH—, —S—$CH_2CH_2$—$CO_2$—$CH_2CH_2$—S—, —S—$CH_2CH_2$—$SO_2$NH—, etc.

Also, the case of $(R_5—Y)_m$ is the same as the foregoing case.

Furthermore, the compound of general formula I having the total carbon number of at most 20 is particularly preferred.

Practical preferred examples of the compounds of general formula I used in this invention are described below but the invention is not limited to these compounds.

(1) $HOCH_2CH_2SCH_2CH_2OCH_2CH_2SCH_2CH_2OH$ (2) $HOCH_2CH(OH)CH_2SCH_2CH_2SCH_2CH(OH)CH_2OH$ (3) $HOCH_2CH_2SCH_2SCH_2CH_2OH$ (4) $HOCH_2CH_2SCH_2CH_2CONHCH_2NHCOCH_2CH_2SCH_2CH_2OH$ (5) $HOCH_2CH_2SCH_2CH_2SCH_2CH_2SCH_2CH_2OH$ (6) $HOCH_2CH(OH)CH_2SCH_2CH_2SCH_2CH_2SCH_2CH(OH)CH_2OH$ (7) $HOCH_2CH_2SCH_2CH_2SCH_2CH_2OH$ (8) $HOCH_2CH_2SCH_2CH_2OH$ (9) $HOCH_2CH_2SCH_2CH_2NHCONHCH_2CH_2OH$

(10) $HOCH_2CH(OH)CH_2SCH_2CH_2C(=O)OCH_2CH_2SCH_2CH(OH)CH_2OH$

(11) $HOCH_2CH_2SCH_2CH_2SO_2NHCH_2CH_2OH$

(12) $CH_2CH(OH)CH_2SCH_2CH_2OH$

(13) $HO(CH_2)_2SC(CH_3)CH(CH_3)SCH_2CH_2OH$

(14) 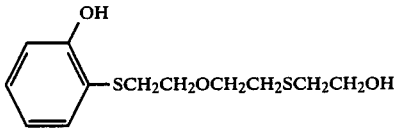

(15) $HOCH_2CH_2SCH(C_6H_5)SCH_2CH_2OH$

(16) $HOCH_2CH_2SCH_2CH(OH)CH_2SCH_2CH_2OH$

(17) $HOCH_2CH_2SCH_2CH_2SCH_2CH_2SCH_2CH_2SCH_2CH_2SCH_2CH_2OH$

(18) $HO(CH_2)_2S(CH_2CH_2O)_{15}CH_2CH_2OH$

(19) $HOCH_2CH_2SCH_2CH_2OCH_2CH_2OCH_2CH_2SCH_2CH_2OH$

(20) $HOCH_2CH_2CH_2SCH_2CH_2SCH_2CH_2CH_2OH$

(21) $HOCH_2CH(OH)CH_2SCH_2—C(=O)—O—CH_2CH_2SCH_2CH_2—O—C(=O)—CH_2SCH_2CH(OH)CH_2OH$

(22) 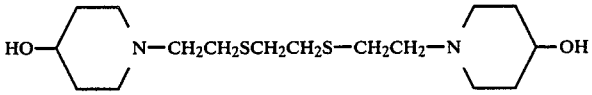

(23) $HO—C_4H_8S(CH_2CH_2O)_{60}COCH_2CH_2OH$

(24) $HOCH_2CH_2SCH_2CH_2SCH_2CH(N(CH_3)_2)CH_2OH$

(25) $CH_3CH_2N(CH_2CH_2SCH_2CH_2OH)_2$

(26) $N(CH_2CH_2SCH_2CH_2OH)_3$

(27) $CH_3C(=O)N(CH_2CH_2SCH_2CH_2OH)_2$

(28) $C(CH_2SCH_2CH_2OH)_4$

(29) 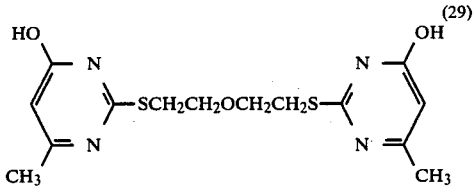

-continued (30)

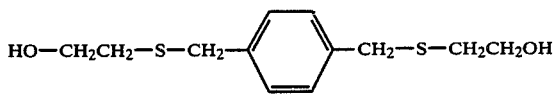

(31)

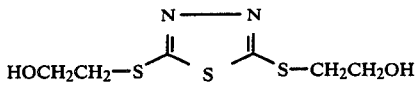

The compounds shown by general formula I can be easily prepared by the methods described in "Shin Jikken Kagaku Koza (New Experimental Chemistry Course)" 14-(III), pages 1715–1726 (edited by the Chemical Society of Japan, published by Maruzen K. K. in 1978) or based on these methods.

Also, symmeteric or asymmetric sulfides can be prepared at high yields by reacting thiol compounds and alkyl halides in the presence of a base. Examples of these reactions are described in detail in "Chem. Ber.", 82, 426(1949); "J. Chem.Soc.", 121, 2882(1922); "Synthesis", 565(1974); "J. S. C. S.", 42, 2385(1920); ibid., 74, 828(1952); ibid., 72, 2856(1950); ibid., 46, 961(1924); ibid., 70, 1381(1948), etc.

Furthermore, the bonding group X in general formula I can be easily prepared based on the methods described in "Shin Jikken Kagaku Koza (New Experimental Chemistry Course)", 14-(II), (III), and (IV).

Typical synthesis methods of the compounds shown by general formula I are illustrated below but other compounds of general formula I can also be easily prepared based on the methods as will be described hereinafter.

SYNTHESIS EXAMPLE 1

Synthesis of $HOCH_2CH_2SCH_2CH_2SCH_2CH_2OH$, 3,6-dithia-1,8-octanediol (Compound (7))

To 25 g of dithioglycol was added dropwise a methanol solution of 1.1 equivalent of sodium methoxide with stirring under ice-cooling. Then, 44 g of ethylene chlorohydrin was gradually added dropwise to the mixture. Thereafter, the mixture was allowed to stand for 10 hours at room temperature and sodium chloride thus precipitated was removed by filtration. The filtrate was concentrated to form colorless crystals, which were recrystallized from acetone to provide 25 g of the desired compound having a melting point of 65° C.

SYNTHESIS EXAMPLE 2

Synthesis of $HOCH_2CH_2SCH_2CH_2OCH_2CH_2OCH_2CH_2SCH_2CH_2OH$, 3,12-dithia-6,9-dioxa-1,14-tetradecanediol (Compound (21))

(1) Synthesis of 3,6-dioxo-1,8-dichlorooctane:

To 283 g of triethylene glycol was added 408 g of thionyl chloride under ice-cooling while keeping the inside temperature at 44° to 45° C. Then, 7 g of pyridine was added to the mixture and the resultant mixture was heated to 140°–145° C. for one hour. The reaction product was purified by distillation to provide 189 g of the desired compound.

(2) Synthesis of 3,12-dithia-6,9-dioxa-1,14-tetradecanediol:

A mixture of 37.4 g of the compound obtained in the foregoing method (1), 21.2 g of sodium carbonate, and 200 ml of 50% ethanol was refluxed for 20 hours and the reaction product was vacuum distilled to provide 7 g of the desired compound having a boiling point (1.5 mmHg) of 215°–225° C.

SYNTHESIS EXAMPLE 3

Synthesis of $HOCH_2CH_2SCH_2CH_2OCH_2CH_2SCH_2CH_2OH$, 3,9-dithia-6-oxa-1,11-undecanediol (Compound (16))

In 50% ethanol were dissolved 15.6 g of 2-mercapto ethanol, 14.3 g of bis-(2-chloroethyl)ether, and 10.6 g of sodium carbonate and the solution was refluxed for 20 hours. After distilling off the solvent under reduced pressure, the product was extracted with absolute ethanol and ethyl acetate and the extract was distilled to provide 7.2 g of the desired compound having a boiling point (1.0 mmHg) of 181° C.

SYNTHESIS EXAMPLE 4

Synthesis of $HOCH_2CH_2CH_2SCH_2CH_2SCH_2CH_2CH_2OH$, 4,7-dithia-1,10-decanediol (Compound (22))

To 300 ml of absolute methanol was added 12.2 g of metallic sodium and then 25 g of dithio glycol was added dropwise to the solution with stirring under ice-cooling. Thereafter, the mixture was stirred for about 30 minutes under ice-cooling and then 52 g of 3-chloro-1-propanol was gradually added dropwise to the mixture. Then, the temperature of the resultant mixture was raised to room temperature and the mixture was allowed to stand for 10 hours at room temperature. Sodium chloride precipitated was removed by filtration under reduced pressure and the filtrate was concentrated. The crystal thus formed was recrystallized from acetone to provide 20 g of the desired compound having a melting point of 52° C.

SYNTHESIS EXAMPLE 5

Synthesis of $HOCH_2CH_2SCH_2SCH_2CH_2OH$, 3,5-dithia-1,7-heptanediol (Compound (3))

In methanol was dissolved 39 g of 2-mercaptoethanol under ice-cooling and then 100 g of sodium methoxide (28% methanol solution) was gradually added dropwise to the solution. After 30 minutes, 43 g of dibromoethane was gradually added dropwise to the mixture and after raising the temperature to room temperature, the mixture was allowed to stand for 15 hours at room temperature. Then, sodium chloride thus precipitated was removed by filtration, the filtrate was concentrated and the product was purified by distillation to provide 21 g of the desired compound having a melting point (0.25 mmHg) of 133° C.

SYNTHESIS EXAMPLE 6

Synthesis of $HOCH_2CH_2SCH_2CH_2OH$, 3-thia-1,5-pentaneidol (Compound (8))

In methanol was dissolved 39 g of 2-mercaptoethanol under ice-cooling and then 200 g of sodium methoxide (28% methanol solution) was gradually added dropwise to the solution. After stirring for 30 minutes, 41 g of ethylene chlorohydrin was gradually added dropwise to the mixture. Thereafter, the temperature of the mixture was raised to room temperature and the mixture was allowed to stand overnight. Sodium chloride thus precipitated was removed by filtration and the filtrate was concentrated. The product obtained was purified by distillation to provide 42 g of the desired compound having a boiling point (20 mmHg) of 165° C.

The compounds shown by general formula I may be used alone or in a combination of two or more compounds and the compound or compounds can be incorporated in at least one of the hydrophilic colloid layers of a silver halide photographic material, such as a protective layer, a silver halide emulsion layer, an interlayer, etc. The amount of the compound or compounds to be incorporated in the layer is preferably $1\times10^{-5}$ to $1\times10^{-1}$ mole, more preferably $5\times10^{-4}$ to $1\times10^{-1}$ mole per mole of the silver halide in the silver halide emulsion layer.

The compound shown by general formula I, may be added by directly dispersing it in a hydrophilic colloid or may be added thereto as a solution of the compound in an organic solvent such as methanol, ethylene glycol, etc. Also, when adding the compound of general formula I to a silver halide emulsion, the compound is, as a matter of course, added to the emulsion after forming silver halide grains but it is preferred that the composition is added to the silver halide emulsion immediately before coating the silver halide emulsion.

By the term "photosensitive" in this invention is meant that the sensitivity of the "photosensitive" silver halide emulsion is higher than the sensitivity of an internally fogged silver halide emulsion. More particularly, the term means that the sensitivity of the "photosensitive" silver halide emulsion is 10 times or higher, more preferably 100 times or more the sensitivity of an internally fogged silver halide emulsion.

In this case, the "sensitivity" has the same meaning as the sensitivity defined as follows.

For photosensitive silver halide emulsion, an ordinary silver halide emulsion such as, for example, a surface latent image-type silver halide emulsion is used. The surface latent image-type silver halide emulsion is a silver halide emulsion that when the emulsion is developed, after exposing for 1 to 1/100 sec., by the process of surface development (A) and the process of internal development (B) as shown below, the sensitivity obtained by the surface development (A) is higher than the sensitivity obtained by the internal development (B), preferably the former sensitivity is defined as follows;

$$S=100E_h$$

wherein S is a sensitivity and $E_h$ is the amount of the light exposure required for obtaining a just intermediate density. $\frac{1}{2}(D_{max}+D_{min})$ between the maximum density ($D_{max}$) and the minimum density ($D_{min}$).

[Surface development (A)]

A silver halide emulsion is developed in a developer having the following composition at 20° C. for 10 minutes.

N-Methyl-p-aminophenol (hemisulfate): 2.5 g
Ascorbic acid: 10 g
Sodium metaborate·tetrahydrate: 35 g
Potassium bromide: 1 g
Water to make: 1 liter

[Internal development (B)]

A silver halide is processed in a bleach solution containing 3 g/liter of potassium hexacyanoferrate (III) and 0.0126 g/liter of phenosafnin at about 20° C. for 10 minutes and after washing with water for 20 minutes, is developed in a developer having the following composition at 20° C. for 10 minutes.

N-Methyl-p-aminophenol (hemisulfate): 2.5 g
Ascorbic acid: 10 g
Sodium metaborate·tetrahydrate: 35 g
Potassium bromide: 1 g
Sodium thiosulfate: 3 g
Water added to make: 1 liter As a silver halide for the surface latent image-type silver halide emulsion, pure silver bromide, silver iodobromide, silver chloride, silver chlorobromide, or silver chloroiodobromide may be used but pure silver bromide or silver iodobromide is preferably used. In this case it is preferred that the content of silver iodide be in a range of 0 to 30 mole%, in particular 0.5 to 10 mole%. Also, it is preferred that the mean grain size of the silver halide emulsion be larger than a silver halide emulsion having fogged nuclei in the inside thereof, in particular, be 0.6 μm or more. The grains having either narrow distribution or broad distribution of grain size may be employed. The silver halide grains in the silver halide emulsion may have a regular crystal form such as a cubic form, an octahedron, etc., an irregular crystal form such as a spherical form, a plate crystal form, etc., or the composite form of these crystal forms. Also, the silver halide grains may be composed of a mixture of various crystal forms. Furthermore, plate-form silver halide grains having a grain diameter of 5 times or more the thickness of the grains are preferably used in this invention.

The photographic silver halide emulsions used in this invention can be prepared by using the methods described in P. Glafkides; "Chimie et Physique Photographique", published by Paul Montel Co., in 1967; G. F. Duffin; "Photographic Emulsion Chemistry; published by The Focal Press in 1966; V. L. Zelikman et al; "Making and Coating Photographic Emulsion", published by the Focal Press, in 1964, etc. That is, the photographic silver halide emulsion may be used by an acid method, a neutralization process, an ammonia process, etc., and also as a method of reacting a soluble silver salt and a soluble halide, a one-side mixing method, a simultaneous mixing method, or a combination of them may be employed.

Furthermore, a so-called back mixing method, i.e., a method of forming the silver halide grains under the presence of an excessive silver ion can be used.

As one of the simultaneous mixing methods, a method of maintaining pAg in a liquid phase, wherein the silver halide is formed, at a constant value, i.e., a so-called controlled double jet method can be used. According to this method, a silver halide emulsion having a regular crystal form and almost a uniform grain size is obtained.

Two or more kinds of silver halide emulsions separately prepared may be used as a mixture thereof.

In the step of forming silver halide grains or physical repening of silver halide grains, a cadmium salt, a zinc salt, lead salt, a thallium salt, an iridium salt or a complex salt thereof, a rhodium salt or a complex salt thereof, an iron salt or a comlex salt thereof, etc., may be present in the system.

After forming the precipitation of the silver halide emulsion used in this invention or after physical ripening of the silver halide emulsion, soluble salts formed are usually removed. The removal of such soluble salts may be performed by a so-called noodle washing method. i.e., a metod of washing the silver halide emulsion after gelling the gelatin of the emulsion or a floculation method using an inorganic salt composed of a polyvalent anion (e. g., sodium sulfate), an anionic surface active agent, an anionic polymer (e. g., polystyrenesulfonic acid), or a gelatin derivative (e. g., a fatty acylated gelatin, an aromatic acylated gelatin, aromatic carbamoylated gelatin, etc.). The step of removing the soluble salts may be, as the case may be, omitted.

The photosensitive silver halide emulsion used in this invention may be a so-called primitive silver halide emulsion, i. e., a silver halide emulsion which is not chemically sensitized, but usually chemically sensitized. For the chemical sensitization, the methods described in P. Glafkides, "Chiemie et Physique Photographique" and V. L. Zelikman et al, "Making and Coating Photographic Emulsion" described above as well as H. Frieser, "Die Graundlagen der Photographischen Prozesse mit Silberhalogeniden, published by Akademische Verlagesgesellshaft, 1968 can be used.

That is, the chemical sensitizqtion can be performed by a sulfur sensitization method using a sulfur-containing compound or active gelatin capable of reacting with a silver ion, a reduction sensitization method using a reducing material, and a noble metal sensitization method using a compound of gold or other noble metal, solely or as a combination of these methods.

As the sulfur sensitizers used in this invention, there are thiosulfates, thioureas, thiazoles, rhodanines, and other compounds and practical examples of them are described in U.S. Pat. Nos. 1,574,944; 2,410,689; 2,278,947; 2,728,668; 3,656,955; 4,032,928; and 4,067,740.

As the reduction sensitizers used in this invention, there are stannous salts, amines, hydrazine derivatines, formamidine, sulfinic acid, silane compounds, etc., and practical examples of them are described in U.S. Pat. Nos. 2,487,850; 2,419,974; 2,518,698; 2,983,609; 2,983,610; 2,694,637; 3,930,867; 4,054,458; etc.

Useful noble metal sensitizers include gold complex salts as well as other complex salts of metals belonging to Group VIII of the periodic table, such as platinum, iridium, palladium, etc., and practical examples of them are described in U.S. Pat. Nos. 2,399,083; 2,448,060; British Pat. No. 618,061, etc.

For the photographic materials of this invention, various hydrophilic colloids can be used as binders.

As colloids used for the purpose, there are, for example, hydrophilic colloids used generally in the field photography, such as gelatin, colloidal albmin, polysaccharide, cellulose derivatives, synthetic resins, polyvinyl compounds including, for example, polyvinyl alcohol derivatives, etc., and acrylamide polymers.

The photographic materials of this invention may contain a hydrophobic colloid such as a dispersed vinyl polymer compound, in particular a compound for increasing the dimensional stability of the photographic materials together with the hydrophilic colloid. Examples of such a hydrophobic colloid are water-insoluble polymers prepared by polymerizing vinyl monomers such as alkyl acrylate, alkyl methacrylate, acrylic acid, sulfoalkyl acrylate, sulfoalkyl methacrylate, etc.

The foregoing photographic silver halide emulsions used in this invention can contain various compounds for preventing the reduction of sensitivity and the formation of fog during the production, preservation, and processing the photographic materials. Examples of such compounds included various well-known compounds such as 4-hydroxy-6-methyl-,3,3a.7-tetraazaindene, 3-methyl-benzothiazole, 1-phenyl-5-mercaptotetrazole, as well as many heterocyclic compounds, mercury-containing compounds, mercapto compounds, metal salts, etc.

Practical examples of the compounds for the purpose are described in K. Mees, "The Theory of the Photographic Process", 3rd edition, 1966 L as well as U.S. Pat. Nos. 1,758,576; 2,110,178; 2,131,038; 2,173,628; 2,697,040; 2,304,962; 2,324,123; 2,394,198; 2,444,605; 2,444,607; 2,444,608; 2,566,245; 2,694,716; 2,697,099; 2,708,162; 2,728,663; 2,728,664; 2,728,665; 2,476,536; 2,824,001; 2,843,491; 2,886,437; 3,052,544; 3,137,577; 3,220,839; 3,226,231; 3,236,652; 3,251,691; 3,252,799; 3,287,135; 3,326,681; 3,420,668; and 3,622,339; British Patent Nos. 893,428; 403,789; 1,173,609; 1,200,188, etc.

Then, as a silver halide emulsion having fogged nuclei in the inside thereof used for the photographic material of this invention, there is a silver halide emulsion which gives a transmission fog density (excluding the density of a support itself) of 0.5 or less when a test piece prepared by coating the silver halide emulsion on a transparent support at a silver coverage of 2 g/m$^2$ is developed by a developer, D-19 (a developer designated by Eastman Kodak Company) at 35° C. for 2 minutes without being light-exposed, and also gives a transmission fog density (excluding the density of the support) of 1.0 or higher when the test piece as described above is developed in a developer prepared by adding 0.5 g/liter of potassium iodide to a developer, D-19 at 35° C. for 2 minutes without being exposed.

The silver halide emulsion having fogged nuclei in the inside thereof can be prepared by various known methods. Useful fogging methods include method of irradiating a silver halide emulsion with light or X rays, a method of chemically forming fogged nuclei in a silver halide emulsion using a reducing agent, a gold compound, or a sulfur-containing compound, and a method of preparing a silver halide emulsion at a low pAg and a high pH. For forming fogged nuclei in the inside only of a silver halide emulsion, there is a method of fogging both the inside and the surface of silver halide grains by the foregoing method and thereafter bleaching the fogged nuclei at the surface thereof with a solution of potassium hexacyanoferrate (III) but a method of preparing a core silver halide emulsion having fogged nuclei by a method of preparing the emulsion at low pAg and high pH or by a chemically fogging method and then covering the periphery of the core emulsion with a shell silver halide emulsion is more preferred. The preparation of the core-shell silver halide emulsion is known as disclosed in, for example, U.S. Pat. No. 3,206,313.

The silver halide emulsion having fogged nuclei in the inside thereof has a mean grain size smaller than that of a surface latent image-type silver halide emulsion and the internally fogged silver halide emulsion preferably has a mean grain size of 1.0 to 0.05 μm, more preferably a mean grain size of 0.6 to 0.1 μm, particularly preferably a mean grain size of 0.5 μm or less.

In addition, the grain size of silver halide grains is a diameter of the grain when the silver halide grain is a spherical grain or a spherical like grain and is a diameter of a sphere having the same volume as the grain when the grain has other form than sphere (e. g., when the grain is a hexahedron, a tetradecanohedron, a cube, a plate form, etc.).

Also, as a silver halide for the internally fogged silver halide emulsion, silver bromide, silver iodobromide, silver iodochloro-bromide, silver chlorobromide, silver chloride, etc., may be used.

Furthermore, it is preferred from the view point of fogging prevention and fix stain prevention that the internally fogged silver halide emulsion has the fogged nuclei at a position of 0.02 μm or more of depth from the surface thereof.

The content ratio of the photosensitive silver halide and the internally fogged silver halide of the silver halide photographic material of this invention depends upon the type of the silver halide emulsions (e. g., the halogen compositions, etc.) used, the kind and the use of the photographic material used, and the contrast of the silver halide emulsions used but is preferably from 100/1 to 1/100, more preferably from 10/1 to 1/10. Also, the silver coverage is preferably 0.5 to 10 g/m$^2$.

The silver halide photographic material of this invention contains the foregoing photosensitive silver halide, the foregoing internally fogged silver halide, and at least one of the foregoing compounds shown by general formula I. These components may be incorporated in a same hydrophilic colloid layer or may be incorporated in separate hydrophilic colloid layers, respectively.

The layer structures of the silver halide photographic materials of this invention may have many embodiments and typical embodiments of the layer structures are as follows.

(1) A structure formed by incorporating the photosensitive silver halide grains, the internally fogged silver halide grains, and the compound shown by general formula I in the same coating composition (silver halide emulsion) and coating the coating composition on a support.

(2) A structure formed by forming a layer (silver halide emulsion layer) containing the internally fogged silver halide grains and the compound of general formula I on a support and further forming on the layer a silver halide emulsion layer containing the photosensitive silver halide grains.

(3) A structure formed by forming a layer (silver halide emulsion layer) containing simultaneously the internally fogged silver halide grains and the photosensitive silver halide grains on a support and further forming on the layer a layer (not silver halide emulsion layer) contquining the compound of general formula I.

(4) A structure formed by forming a layer containing the photosensitive silver halide grains, the internally fogged silver halide grains, and the compound of general formula I on a support, forming thereon a silver halide emulsion layer containing the photosensitive silver halide grains and the compound of general formula I, and further forming on the layer a protective layer.

(5) A structure formed by forming a non silver halide emulsion layer containing the compound of general formula I, forming on the layer a layer containing the photosensitive silver halide grains and the internally fogged silver halide grains, and further forming thereon a protective layer.

This invention is not, however, limited to the foregoing embodiments. Also, these layers may be formed on both surfaces of a support.

The protective layer of the silver halide photographic material of this invention is a layer composed of a hydrophilic colloid and the foregoing materials are used as the hydrophilic colloid. Also, the protective layer may be a single layer or a double layer.

The silver halide emulsion layer or the protective layer, preferably the protective layer of the silver halide photographic material may contain a matting agent and/or a smoothening agent. As the matting agent, an organic compound such as polymethylacrylate and a water-dispersible vinyl polymer and an inorganic compound such as silver halide and strontium barium sulfate each having a proper grain size (grain size of 0.3 to 5μ or preferably a grain size of larger than twice, preferably larger than 4 times the thickness of the protective layer) are preferably used. The smoothening agent is useful for preventing adhesion trouble as the case of using the matting agent and is particularly effective for improving friction characteristics in relation to the camera aptitude of a cinne film when photographing or projecting. Practical examples of the smoothening agent are waxes such as liquid paraffin, esters of higher fatty acids, etc.; polyfluorinated hydrocarbons or the derivatives thereof; silicones such as polyalkyl polysiloxanes, polyaryl polysiloxanes, polyalkylaryl polysiloxanes, and the alkylene oxide addition derivatives thereof.

The silver halide photographic material of this invention may further have, if necessary, an antihalation layer, an interlayer, a filter layer, etc.

The photographic silver halide emulsion layers and other hydrophilic colloid layers of the photographic materials of this invention can be hardened by a proper hardening agent. Examples of the hardening agent are the vinylsulfonyl compounds as describedin Japanese Patent Application (OPI) Nos. 76,025/'78; 76,026/'78; and 77,619/'78; hardening agents having an active halogen; dioxane derivatives, oxypolysaccharides such as oxystarch, etc.

The photographic silver halide emulsion layers in this invention may further contain other additives, in particular the additives useful for the photographic emulsions, such as a lubricant, a sensitizer, a light absorbing dye, a plasticiaer, etc.

Further, in this invention a compound capable of releasing an iodine ion (e. g., potassium iodide) may be incorporated in the silver halide emulsion layer and also a desired image can be obtained by using a developer containing an iodine ion.

The photographic material of this invention may further contain a water-soluble dye in the hydrophilic colloid layer as a filter dye or for other various purposes for anti-irradiation and antihalation. Examples of such dyes are oxonol dyes, hemioxonol dyes, styryl dyes, merocyanine dyes, cyane dyes, and azo dyes. In these dyes, oxonol dyes, hemioxonol dyes, and merocyanine dyes are particularly useful.

When in the silver halide photographic material of this invention the hydrophilic colloid layer contains a dye or a ultraviolet absorbent, they may be mordanted by a cationic polymer, etc.

The silver halide photographic materials of this invention may further contain surface active agents for various purposes. According to purposes, nonionic surface active agents, ionic surface active agents, or amphoteric surface active agents may be used and as such surface active materials, there are polyoxyalkylene derivatives, amphoteric aminoacids (including sulfobetaines), etc. Practical examples of these surface active agents are described in U.S. Pat. Nos. 2,600,831; 2,271,622; 2,271,623; 2,275,727; 2,787,604; 2,816,920 and 2,739,891 and Belgian Pat. No. 652,862.

The photographic silver halide emulsions in the photographic materials of this invention may be spectrally sensitized to blue light, green light, red light, or infrared light each having a relatively longer wave length by a sensitizing dye. Examples of the sensitizing dyes used for the purpose are cyanine dyes, merocyanine dyes, complex cyanine dyes, complex merocyanine dyes, holoholar cyanine dyes, styryl dyes, hemicyanine dyes, oxonol dyes, hemioxonol dyes, etd.

Practical examples of the useful sensitizing dyes used in this invention are described in, for example, U.S. Pat. Nos. 3,522,052; 3,619,197; 3,713,828; 3,615,643; 3,615,632; 3,617,293; 3,628,964; 3,703,377; 3,666,480; 3,667,960; 3,679,428; 3,672,897; 3,769,026; 3,556,800; 3,615,613; 3,615,638; 3,615,635; 3,705,809; 3,623,349; 3,677,765; 3,770,449; 3,770,440; 3,769,025; 3,745,014; 3,713,828; 3,567,458; 3,625,698; 2,526,632; and 2,503,776; Japanese Patent Application (OPI) No. 76,525/'73; and Belgian Pat. No. 691,807.

The sentitizing dye in this invention is used in the same concentration as those used for ordinary negative-type silver halide emulsions. It is particularly useful to use the sensitizing dye at a concentration of substantially not reducing the specific sensitivity of the silver halide emulsion. It is preferred to use the sensitizing dye at a concentration of about $10\times10^{-5}$ to about $5\times10^{-4}$ mole, in particular, of about $4\times10^{-5}$ to about $2\times10^{-4}$ mole per mole of silver halide in the silver halide emulsion.

In the silver halide photographic material of this invention the photographic silver halide emulsion layer and other layer or layers are formed on one surface or both surfaces of a flexible support usually used for photographic materials. Examples of useful supports are films of synthetic polymers such as cellulose acetate, cellulose acetate butyrate, polyethylene teraphthalate, etc., and baryta-coated papers, and papers coated or laminated with an $\alpha$-olefin polymer (e. g., polyethylene, etc.).

In the silver halide photographic material of this invention the photographic silver halide emulsion layer or layers and other hydrophilic colloid layer or layers can be coated on a support or one other layer on the support by various known coating methods, such as a dip coating method, a roller coating method, a curtain coating method, an extrusion coating method, etc. The coating methods described in U.S. Pat. Nos. 2,681,294; 2,761,791; and 3,526,528 can be profitably used.

The present invention can be applied to any silver halide photographic material requiring high sensitivity or high contrast. For example, the invention can be applied to X-ray photographic materials, lithographic photographic materials, black and white photographic materials, color negative photographic materials, color photographic papers, etc.

Furthermore, the invention can be applied to a diffusion transfer photographic material and a color diffusion transfer photographic material each forming a positive image by dissolving an undeveloped silver halide and precipitating it on an image-receiving layer disposed adjacent to a silver halide emulsion layer.

The silver halide photographic materials of this invention can be processed by the known process and the known processing solution described in, for example, "Research Disclosure", No. 176, pages 28–30 (RD-17643). The photographic processing for processing the photographic materials of this invention may be a photographic process (black and white photographic process) for forming a silver image of a photographic process (color photographic process) for forming a dye image according to a purpose. The processing temperature is usually selected in a range of 18° C. to 50° C. but may be lower than 18° C. or higher than 50° C.

For example, the developer used for processing a black and white photographic material may contain a known developing agent, such as dihydroxybenzenes (e. g., hydroquinone, etc.), 3-pyrazolidones (e. g., 1-phenyl-3-pyrazolidone), aminophenols (e. g., N-methyl-p-aminophenol), etc. They may be used solely or as a combination of them.

The silver halide photographic materials of this invention can be processed by a developer containing the imidazole as a silver halide solvent as described in Japanese Patent Application No. 155,489/'80. Also the photographic materials of this invention may be processed by a developer containing a silver halide solvent and an additive such as indazole and triazole as described in Japanese Patent Application No. 136,267/'81.

The developers used for processing the photographic materials of this invention may generally contain other additives such as preservatives, alkalifying agents, pH buffers, antifoggants, etc., and further, if necessary, dissolution aids, toning agents, development accelerators, surface active agents, defoaming agents, water softeners, hardening agents, takifiers, etc.

For the silver halide photographic materials of this invention may be applied a so-called "lithographic type" development process. The "lithographic type" development process is a development process which infectiously performs a development step under a low concentration of a sulfite ion using usually a dihydroxybenzene as a developing agent for the photographic reproduction of line images or the photographic reproduction of a half tone image by dot. Details of such a development are described in Mason, "Photogrraphic Processing Chemistry"; 163–165(1966).

In a specific system of a development process, a developing agent is incorporated in the silver halide photographic material, for example, in a silver halide emulsion layer of the photographic material and the photographic material may be developed by processing it in an aqueous alkali solution. A hydrophobic developing agent can be incorporated in a silver halide emulsion layer by the various methods described in "Research Disclosure", No. 169 (RD-16928); U.S. Pat. No. 2,739,890; British Pat. No. 813,253; and West German Pat. No. 1,547,763. Such a development process may be performed in combination with a silver salt stabilization process using a thiocyanate.

For fixing the developed photographic materials of this invention, a fix solution having a conventional composition used may be used. Examples of fixing agents include a thiosulfate, a thiocyanate, as well as an organic sulfur compound which is known to have an effect as a fixing agent. The fix solution may further contain a water-soluble aluminum salt as a hardening agent.

The invention will now be further described more practically by the following examples. However the scope of the invention is not limited to the examples.

EXAMPLE 1

(1) Preparation of photosensitive silver halide emulsion:

A silver iodobromide emulsion (AgI: 2 mole%) having a mean grain size of 1.3$\mu$ was prepared from silver nitrate, potassium bromide, and potassium iodide by an ordinary ammonia method, chemically sensitized by a gold and sulfur sensitization method using chloroauric acid and sodium thiosulfate, salts formed were removed by an ordinary aggregation method, and then 4-hydroxy-6-methyl-1,3,3a,7-tetraazaindene was added to the emulsion as a stabilizer to provide a photosensitive silver iodobromide emulsion A.

(2) Preparation of internally fogged silver halide emulsion:

Core silver halide grains were prepared by simultaneously adding an aqueous silver nitrate solution and an aqueous potassium bromide solution to an aqueous 2 wt% gelatin solution with stirring at 55° C. After raising the temperature to 75° C., a proper amount of sodium hydroxide and a proper amount of silver nitrate were added to the core silver halide emulsion and then the emulsion was ripened for 15 minutes to form fogged nuclei on the core grains. After lowering the temperature to 55° C., acetic acid and potassium bromide were added to the emulsion to adjust the pH and pAg to the original values, an aqueous silver nitrate solution and an aqueous potassium bromide solution were simultaneously added to the emulsion, salts formed were removed by an ordinary aggregation method, and the residue was redispersed in an aqueous gelatin solution to provide an internally fogged silver bromide emulsion B having a mean grain size of 0.37$\mu$.

(3) Preparation of comparison samples 1 to 5:

A comparison sample 1 was prepared by uniformly coating, in succession, a mixture of the photosensitive silver halide emulsion A and the internally fogged silver halide emulsion B prepared in foregoing steps (1) and (2) as a silver halide emulsion layer and an aqueous gelatin solution as a protective layer on a polyester base having a subbing layer. Then, comparison samples 2 to 5 were prepared by uniformly coating, in succession, a mixture of the photosensitive silver halide emulsion A and the internally fogged silver halide emulsion B containing each of following comparison compounds (a) to (d) in an amount of $3.9\times10^{-3}$ mole per mole of the silver halide in the mixture of the silver halide emulsions as a silver halide emulsion layer and then an aqueous gelatin solution as a protective layer.

Comparison compound (a)

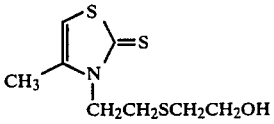

Comparison compound (b)
$H_3COOCCH_2CH_2SCH_2CH_2SCH_2CH_2COOCH_3$

Comparison compound (c)
$HOC_2H_4SC_8H_{17}$

Comparison compound (d)

-continued

KSCN

In this case the comparison compound (a) is the most preferred compound shown in the examples of Japanese Patent Application (OPI) No. 89,749/82, the comparison examples (b) and (c) are the compounds described in the foregoing patent application most similar to the compounds of this invention, and the comparison compound (d) is a general silver halide solvent disclosed in U.S. Pat. No. 2,996,382, etc.

In comparison samples 1 to 5, the silver coverage was all 1.7 g/m$^2$ for silver halide emulsion A and 1.7 g/m$^2$ for silver halide emulsion B, the gelatin coverage of the protective layer was all 1.3 g/m$^2$, and the gelatin coverage of the silver halide emulsion layer was all 2.2 g/m$^2$.

(4) Preparation of the invention samples 6 to 11:

To a silver halide emulsion mixture of the photosensitive silver halide emulsion A and the internally fogged silver halide emulsion B as in the cases of comparison samples 2 to 5 was added each of Compound (1) to (6) of this invention in an amount of $3.9\times10^{-3}$ mole for Compound (1) to (3) each, $2.6\times10^{-3}$ mole for Compound (4), and $1.3\times10^{-3}$ for Compound (5) and (6) each per mole of the silver halide in the silver halide emulsion mixture.

Each of the invention samples 6 to 11 was then prepared by uniformly coating, in succession, each of the silver halide emulsion mixtures thus obtained and an aqueous gelatin solution for a protective layer on a polyester base having a subbing layer. In this case the silver coverage was all 1.7 g/m$^2$ for silver halide emulsion A and 1.7 g/m$^2$ for silver halide emulsion B, the gelatin coverage of the protective layer was all 1.3 g/m$^2$, and the gelatin coverage of the silver halide emulsion layer was all 2.2 g/m$^2$.

(5) Each of comparison samples 1 to 5 and invention samples 6 to 11 thus prepared was wedge exposed to light, developed in developer A having the following composition at 35° C. for 25 sec., fixed washed, dried, and then subjected to a sensitometry.

[Composition of developer A]

Potassium hydroxide: 29.14 g
Glacial acetic acid: 10.96 g
Potassium sulfite: 44.20 g
Sodium hydrogencarbonate: 7.50 g
Boric acid: 1.00 g
Diethylene glycol: 28.96 g
Ethylenediaminetetraacetic acid: 1.67 g
5-Methylbenzotriazole: 0.06 g
5-Nitroindazole: 0.25 g
Hydroquinone: 30.00 g
1-Phenyl-3-pyrazolidone: 1.50 g
Glutaraldehyde: 4.93 g
Sodium metahydrogensulfite: 12.60 g
Potassium bromide: 7.00 g
Water to make: 1 liter; pH adjusted to: 10.25.

The results obtained are shown in Table 1.

TABLE 1

| Sample no. | Addition compound | Amount of compound* | Photographic properties: Relative sensitivity | Maximum density | Gamma | Fog |
|---|---|---|---|---|---|---|
| 1 | none | — | 100 | 0.8 | 0.4 | 0.06 |
| 2 | Comparison (a) compound | $3.9\times10^{-3}$ mole | 105 | 1.0 | 0.5 | 0.12 |
| 3 | Comparison (b) compound | " | 90 | 0.8 | 0.4 | 0.08 |

TABLE 1-continued

| Sample no. | Addition compound | Amount of compound* | Photographic properties: Relative sensitivity | Maximum density | Gamma | Fog |
|---|---|---|---|---|---|---|
| 4 | Comparison (c) compound | " | 95 | 0.8 | 0.4 | 0.08 |
| 5 | Comparison (d) compound | " | 95 | 0.8 | 0.4 | 0.10 |
| 6 | Compound (1) | " | 195 | 2.6 | 2.4 | 0.07 |
| 7 | Compound (2) | " | 200 | 2.6 | 2.5 | 0.06 |
| 8 | Compound (3) | " | 160 | 2.6 | 1.3 | 0.07 |
| 9 | Compound (4) | $2.6 \times 10^{-3}$ mole | 200 | 2.6 | 2.5 | 0.06 |
| 10 | Compound (5) | $1.3 \times 10^{-3}$ mole | 195 | 2.6 | 2.4 | 0.07 |
| 11 | Compound (6) | " | 210 | 2.6 | 2.5 | 0.06 |

*The amount per mole of silver halide
Sample nos. 1 to 5: Comparison samples
Sample nos. 6 to 11: Samples of this invention
Relative sensitivity was shown by defining the sensitivity of sample no. 1 being 100.

As is clear from the results shown in Table 1, comparison samples 2 to 5 containing comparison compounds (a) to (d), respectively do not show sufficient sensitivity, maximum density, and gamma as compared to those of comparison sample 1. On the other hand, the invention samples 6 to 11 containing Compounds (1) to (6), respectively, of this invention show high sensitivity, high contrast, and high $D_m$ (maximum density) with the same addition amount as that in the comparison samples or less addition amount than that in the comparison samples, which shows the remarkable effects of this invention. That is, the compounds of this invention shown by general formula I give particularly excellent effects on high sensitivity, high contrast, and high $D_m$ as compared to the compounds described in Japanese Patent Application (OPI) No. 89,749/82 and the general silver halide emulsion disclosed in U.S. Pat. No. 2,996,382. Also, the foregoing results suggest that it is important that $R_1$ and $R_2$ in general formula I of this invention have many hydroxy groups.

EXAMPLE 2

Each of comparison examples 1 to 5 and the invention samples 6 to 11 prepared by the same ways as in Example 1 was wedge exposed to light, developed in developer B having the following compositions at 20° C. for 4 minutes, fixed, washed, dried, and subjected to a sensitometery.

[Composition of developer B]

1-Phynyl-3-pyrazolidone: 0.5 g
Hydroquinone: 20.0 g
Ethylenediaminetetraacetic acid disodium: 2.0 g
Potassium sulfite: 60.0 g
Boric acid: 4.0 g
Potassium carbonate: 20.0 g
Sodium bromide: 20.0 g
Diethylene glycol: 30.0 g
Water to make: 1 liter pH adjusted to 10.0 with NaOH.

The results are shown in Table 2.

TABLE 2

| Sample no. | Addition amount | Amount of compound* | Photographic properties: Relative sensitivity | Maximum density | Gamma | Fog |
|---|---|---|---|---|---|---|
| 1 | none | — | 100 | 1.2 | 0.5 | 0.08 |
| 2 | Comparison (a) compound | $3.9 \times 10^{-3}$ mole | 105 | 1.3 | 0.5 | 0.15 |
| 3 | Comparison (b) compound | " | 95 | 1.2 | 0.5 | 0.09 |
| 4 | Comparison (c) compound | " | 95 | 1.2 | 0.5 | 0.10 |
| 5 | Comparison (d) compound | " | 95 | 1.2 | 0.5 | 0.13 |
| 6 | Compound (1) | " | 330 | 2.6 | 2.9 | 0.09 |
| 7 | Compound (2) | " | 350 | 2.6 | 3.1 | 0.08 |
| 8 | Compound (3) | " | 210 | 2.5 | 1.8 | 0.09 |
| 9 | Compound (4) | $2.6 \times 10^{-3}$ mole | 350 | 2.6 | 3.2 | 0.08 |
| 10 | Compound (5) | $1.3 \times 10^{-3}$ mole | 330 | 2.6 | 2.9 | 0.09 |
| 11 | Compound (6) | " | 365 | 2.6 | 3.1 | 0.08 |

*The amount per mole of silver halide
Sample Nos. 1 to 5: Comparison samples
Sample nos. 6 to 11: Samples of this invention
Relative sensitivity was shown by defining the sensitivity of sample no. 1 being 100.

As is clear from the results shown in Table 2, samples 6 to 11 of this invention containing the compounds of this invention can give images having excellent sensitivity, maximum density, and gamma even by ordinary low-temperature development processing as those in Example 1 as compared to the comparison samples 1 to 5. Also, the desired effects could be obtained by the development for a definite period of time and hence it can be said that the development time could be shortened.

EXAMPLE 3

(1) Preparation of Samples 12 to 14:

Comparison sample 13 having a three layer structure was prepared by coating, in succession, an emulsion mixture of the photosensitive silver halide emulsion A and the internally fogged silver halide emulsion B as described in Example 1, an emulsion composed of the photosensitive silver halide emulsion A alone, and an aqueous gelatin solution for a protective layer on a polyester base having a subbing layer. Also, each of samples 13 and 14 of this invention having a three layer structure was prepared by coating, in succession, an emulsion mixture of the photosensitive silver halide emulsion A and the internally fogged silver halide emulsion B containing Compound (2) of this invention in an amount of $3.9\times10^{-3}$ mole per silver halide in the emulsion mixture or Compound (4) of this invention in an amount of $2.6\times10^{-3}$ mole per mole of silver halide in the emulsion mixture, an emulsion composed of the photosensitive silver halide emulsion A alone, and an aqueous gelatin solution for a protective layer on a polyester base having a subbing layer.

In samples 12 to 14 thus prepared, the silver coverage of the lower silver halide layer was 0.7 g/m$^2$ for the photosensitive silver halide emulsion A and 0.7 g/m$^2$ for the internally fogged silver halide emulsion B, the silver coverage of the photosensitive silver halide emulsion A in the upper silver halide emulsion layer was 2.0 g/m$^2$, the gelatin coverage of the protective layer of 1.3 g/m$^2$, and the gelatin coverage of the silver halide emulsion layers was 2.2 g/m$^2$.

(2) Each of comparison sample 12 and samples 13 and 14 of this invention was wedge exposed to light, developed in developer A described in Example 1 at 35° C. for 25 sec., fixed, washed, dried, and subjected to a sensitometry.

The results are shown in Table 3.

TABLE 3

| Sample no. | Addition compound | Addition amount* | Photographic properties: Relative sensitivity | Maximum density | Gamma | Fog |
|---|---|---|---|---|---|---|
| 12 | none | — | 100 | 1.10 | 0.7 | 0.04 |
| 13 | Compound (2) | $3.9\times10^{-3}$ mole | 120 | 1.95 | 2.0 | 0.04 |
| 14 | Compound (4) | $2.6\times10^{-3}$ mole | 120 | 1.90 | 2.0 | 0.04 |

*The amount per mole of silver halide in the lower silver halide emulsion layer
Sample No. 12: Comparison sample
Sample Nos. 13 and 14: Samples of this invention
Relative sensitivity was shown by defining the sensitivity of Sample no. 12 being 100.

As is clear from the results shown in Table 3, the invention is also effective in the layer structure as shown in sample nos. 13 and 14. That is, the invention can be effectively applied without restriction on layer structure.

While the invention has been described in detail and with reference to specific embodiment thereof, it will be apparent to one skilled in the art that various changes and modifications can be made therein without departing from the spirit and scope thereof.

What is claimed is:

1. A silver halide photographic material comprising a support having thereon at least one silver halide layer comprising a support having thereon at least one silver halide emulsion layer, wherein the photographic material contains in the same emulsion layer or in separate layers (1) internally fogged silver halide grains, (2) Surface latent image silver halide grains more sensitive than the internally fogged silver halide grains, and (3) at least one of the compounds represented by the following general formula (I)

$$R_1\{(R_3)_l X\}_n R_3'-R_2 \qquad (I)$$

wherein $R_1$ and $R_2$ each represents a substituted or unsubstituted alkyl group having a hydroxy group, a substituted or unsubstituted aryl group having a hydroxy group, or a substituted or unsubstituted heterocyclic ring having a hydroxy group; $R_3$ and $R_3'$ each represents a substituted or unsubstituted alkylene group, a substituted or unsubstituted arylene group, a substituted or unsubstituted heterocyclic ring, or a combination of them; X represents $$-S-,\ -O-,\ -\overset{O}{\overset{\|}{C}}-O-,\ -\overset{O}{\overset{\|}{C}}-,\ -SO_2-,\ -CONR_4-,$$

$$NR_4\overset{O}{\overset{\|}{C}}NR_4-,\ -SO_2NR_4-,\ -NR_4-,\ -CHR_4-,\ \text{or}$$

$$-C(R_4)_2-,$$

wherein, $R_4$ represents a hydrogen atom or $\{R_5-Y-\}_m R_5'-R_6$; $R_5$ and $R_5'$ have the same significance as $R_3$ and $R'_3$; $R_6$ represents a substituted or unsubstituted alkyl group or a substituted or unsubstituted aryl group; Y represents $$-S-,\ -O-,\ -\overset{O}{\overset{\|}{C}}-O-,\ -SO_2-,\ -\overset{O}{\overset{\|}{C}}-,$$

$$-NR_7CONR_7-,\ \text{or}\ -SO_2NR_7-;$$

$R_7$ has the same significance as $R_6$; and m represents an integer of 0 to 10; l represents 0 or 1; and n represents an integer of 1 to 110; in the formula, when n is 2 or more X and $R_3$ each may be the same or different, when m is 2 or more Y and $R_5$ each may be the same or different and at least one X is a sulfur atom said at least one of the compounds represented by formula (I) is present in an amount sufficient to provide an image having a high maximum density at a high speed and a high contrast.

2. A silver halide photographic material as claimed in claim 1, wherein $R_1$ and $R_2$ each represents a substituted or unsustituted alkyl group having a hydroxy group wherein the alkyl groups contain 1 to 20 carbon atoms.

3. A silver halide photographic material as claimed in claim 1, wherein $R_1$ and $R_2$ each represents a substituted or unsubstituted aryl group having an hydroxy group and wherein the aryl group contains 6 to 20 carbon atoms.

4. A silver halide photographic material as claimed in claim 1, wherein $R_3$ and $R_3'$ each represents a substituted or unsubstituted alkylene group having 1 to 20 carbon atoms.

5. A silver halide photographic material as claimed in claim 1, wherein $R_3$ and $R_3'$ each represents a substituted or unsubstituted arylene group having 6 to 20 carbon atoms.

6. A silver halide photographic material as claimed in claim 1, wherein X of the general formula I is $$-O-,\ -S-,\ -\overset{O}{\overset{\|}{C}}-O-,\ -\overset{O}{\overset{\|}{C}}-,\ -SO_2-,\ \text{or}\ -CONH-,$$

$$-NH\overset{O}{\overset{\|}{C}}NH-,\ -SO_2NH-,\ -NH-,\ \text{or}\ -CH_2-.$$

7. A silver halide photographic material as claimed in claim 1, wherein X is —S—, —O—, or —CONH—.

8. A silver halide photographic material as claimed in claim 1, wherein n is in the range of 1 to 110.

9. A silver halide photographic material as claimed in claim 8, wherein n is in the range of 1 to 10.

10. A silver halide photographic material as claimed in claim 1, wherein $R_4$ is $\{R_5—Y\}_m R_5'—R_6$, m is in the range of 0 to 10.

11. A silver halide photographic material as claimed in claim 1, wherein the compound having the general formula I contains 20 carbon atoms or less.

12. A silver halide photographic material as claimed in claim 1, wherein the compound having the general formula I is present in an amount in the range of $1\times10^{-5}$ to $1\times10^{-1}$ mole per mole of silver halide.

13. A silver halide photographic material as claimed in claim 1, wherein the content ratio of the surface latent image silver halide grains more sensitive than the internally fogged silver halide grains and the internally fogged silver halide is from 100/1 to 1/100.

14. A silver halide photographic material as claimed in claim 1, wherein the silver coverage is 0.5 to 10 g/m$^2$.

15. A silver halide photographic material as claimed in claim 1, wherein the photographic material has a structure formed by the support, and a silver halide emulsion layer containing the surface latent image silver halide grains more sensitive than the internally fogged silver halide grains, the internally fogged silver halide grains and the compound represented by the general formula (I) of claim 1.

16. A silver halide photographic material as claimed in claim 1, wherein the photographic material has a structure formed by the support, a silver halide emulsion layer (I) containing the internally fogged silver halide grains and the compound represented by the general formula (I) of claim 1, and a silver halide emulsion layer (II) containing the surface latent image silver halide grains more sensitive than the internally fogged silver halide grains.

17. A silver halide photographic material as claimed in claim 1, wherein the photographic material has a structure formed by the support, a silver halide emulsion layer containing the internally fogged silver halide grains and the surface latent image silver halide grains more sensitive than the internally fogged silver halide grains and a non-silver halide emulsion layer containing the compound represented by the general formula (I) of claim 1.

18. A silver halide photographic material as claimed in claim 1, wherein the photosensitive material has a structure formed by the support, a layer containing the surface latent image silver halide grains more sensitive than the internally fogged silver halide grains, the internally fogged silver halide grains and the compound of general formula (I) and a silver halide emulsion layer containing the surface latent image silver halide grains more sensitive than the internally fogged silver halide grains and the compound represented by the general formula (I) of claim 1 and a protective layer.

19. A silver halide photographic material as claimed in claim 1, wherein the photosensitive material has a structure formed by the support, a non-silver halide emulsion layer containing the compound represented by the general formula (I), a silver halide emulsion layer containing the surface latent image silver halide grains more sensitive than the internally fogged silver halide grains and the internally fogged silver halide grains, and a protective layer.

20. A silver halide photographic material as claimed in claim 1, wherein the surface latent image silver halide grains more sensitive than the internally fogged silver halide grains are 10 or more times more sensitive than the internally fogged silver halide grains.

21. A silver halide photographic material as claimed in claim 1, wherein the surface latent image silver halide grains more sensitive than the internally fogged silver halide grains are 100 or more times more sensitive than the internally fogged silver halide grains.

* * * * *